US008336242B2

(12) United States Patent
Useche

(10) Patent No.: US 8,336,242 B2
(45) Date of Patent: Dec. 25, 2012

(54) CONVERTIBLE DIPLOMA/CERTIFICATE HOLDER AND WALL DISPLAY

(75) Inventor: Wilmer Enrique Useche, Chicago, IL (US)

(73) Assignee: The Diplomatic Company, Chicago, IL (US)

( * ) Notice: Subject to any disclaimer, the term of this patent is extended or adjusted under 35 U.S.C. 154(b) by 148 days.

(21) Appl. No.: 12/957,471

(22) Filed: Dec. 1, 2010

(65) Prior Publication Data

US 2011/0088301 A1 Apr. 21, 2011

Related U.S. Application Data

(63) Continuation-in-part of application No. 12/039,708, filed on Feb. 28, 2008, now abandoned.

(51) Int. Cl.
*A47G 1/06* (2006.01)

(52) U.S. Cl. ..... 40/777; 402/77

(58) Field of Classification Search ..... 40/777
See application file for complete search history.

(56) References Cited

U.S. PATENT DOCUMENTS 2,333,523 A * 11/1943 Cohun ..... 281/16
2,879,774 A * 3/1959 Siegel ..... 40/124.2
3,616,558 A * 11/1971 Jahn ..... 40/711
6,101,752 A * 8/2000 Cumberland ..... 40/778
6,199,439 B1 * 3/2001 Lin ..... 74/61
2004/0136774 A1 * 7/2004 O'Boyle ..... 402/73
2008/0085146 A1 * 4/2008 Botkin ..... 402/70

* cited by examiner

*Primary Examiner* — Joanne Silbermann
(74) *Attorney, Agent, or Firm* — Justin Lampel

(57) ABSTRACT

The present invention generally relates to a multi-purpose, double paneled, convertible apparatus which may be used as a protective holder and/or wall display for a diploma, certificate, photograph or the like. The apparatus may provide a safe and secure manner for receiving, holding, transporting, protecting, and/or storing, for example, the diploma, certificate, photograph or the like and further may quickly be converted to provide an attractive display for hanging the diploma, certificate, photograph or the like on a wall. The apparatus may have a first panel which may be connected to a second panel. Further, the first panel may rotate with respect to the second panel. The second panel may store the diploma, certificate, photograph or the like while the first panel may provide a cover for the diploma, certificate, photograph or the like. The second panel may have at least one strap which may secure the first panel, when rotated behind the second panel. In an embodiment, the apparatus has a memory page for writing notes and a light and speaker feature for which may be used to view the diploma and play a message or song. The apparatus may have a double-faced mat to accommodate diplomas of different sizes.

10 Claims, 13 Drawing Sheets

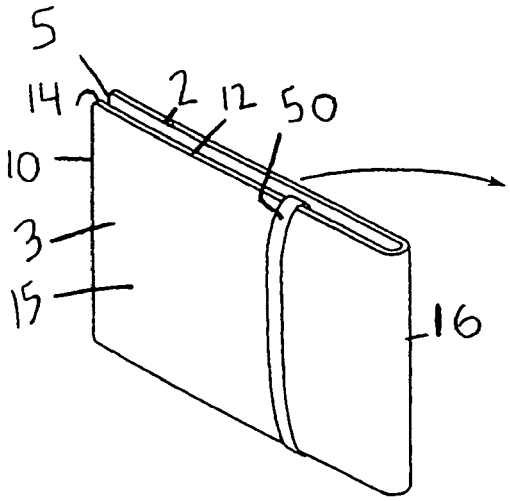
FIG 3A
FIG. 3B
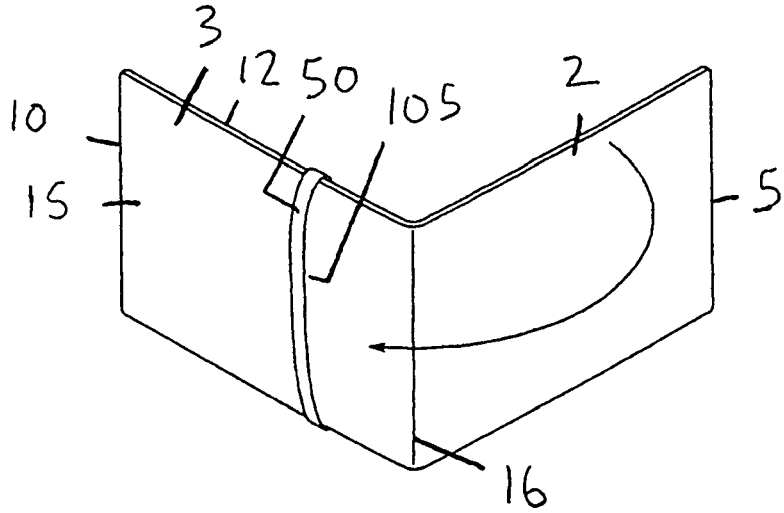
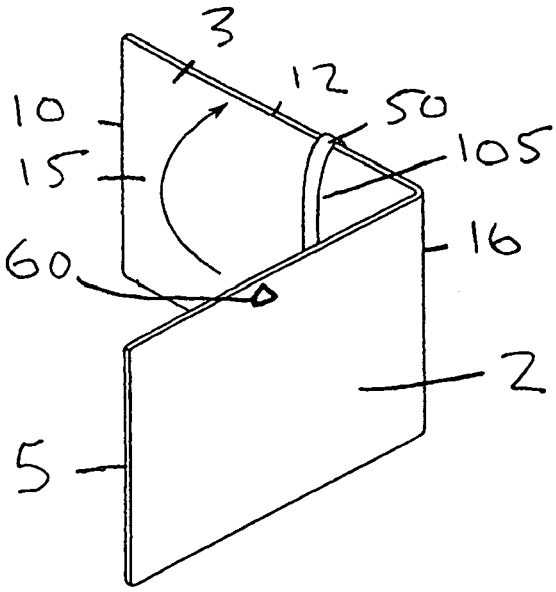
FIG 3C
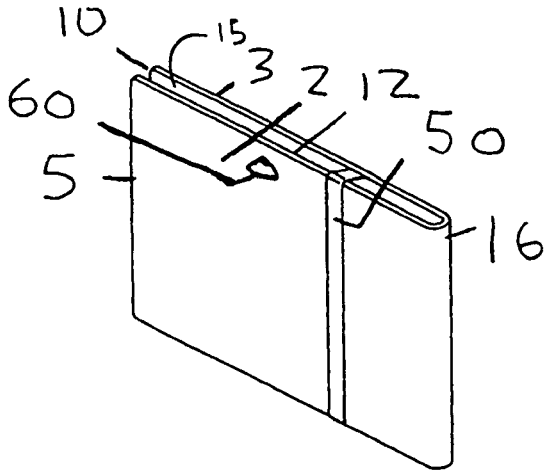
FIG 3D

CONVERTIBLE DIPLOMA/CERTIFICATE HOLDER AND WALL DISPLAY

CROSS-REFERENCES TO RELATED APPLICATIONS

This application is a Continuation-In-Part of U.S. patent application Ser. No. 12/039,708 filed Feb. 28, 2008, now abandoned, the entire contents of which are herein fully incorporated by reference. This application claims the priority benefit of the same.

BACKGROUND OF THE INVENTION

The present invention generally relates to a multi-purpose, double paneled, convertible apparatus which may be used as a protective holder and/or wall display for a diploma, certificate, photograph or the like. The apparatus may provide a safe and secure manner for receiving, holding, transporting, protecting, and/or storing, for example, the diploma, certificate, photograph or the like and further may quickly be converted to provide an attractive display for hanging the diploma, certificate, photograph or the like on a wall. In addition, the apparatus may be used to display the diploma, certificate, photograph or the like on, for example, a table. The apparatus may have a first panel which may be connected to a second panel. Further, the first panel may rotate with respect to the second panel. The second panel may store the diploma, certificate, photograph or the like while the first panel may provide a cover for the diploma, certificate, photograph or the like. The second panel may have at least one strap which may secure the first panel, when rotated behind the second panel. In addition, the reverse side of the first panel may have an attachment for hanging the apparatus on, for example, a wall.

U.S. Pat. No. 6,775,939 to Juern discloses a reversible display frame combination that may be pivotably mounted on a wall so as to enable its rotation while mounted to enable a user to selectively show the display item(s) contained therein from either side without a change in appearance of the combination, and method for employing same. The display frame combination comprises a reversible display frame and a suspension device. The reversible display frame comprises generally a frame member and one or more suspension rings attached to the frame member. In one version, the suspension rings are retractable. The suspension device enables rotation at a wall assembly by means of a pivotally coupled upper and lower loop member.

U.S. Pat. No. D396, 350 to Panzenhagen discloses an ornamental design for a picture frame apparatus.

U.S. Pat. No. 4,947,565 to Shadwell discloses a rectangular picture frame that can be opened and closed repeatedly for mounting and changing the picture to be displayed in the frame. The picture framing device is characterized by a rigid backing sheet, which is hinge mounted along one edge of the frame and releasable secured to the frame along its other three edges with adhesive tape. A triangular corner section of the backing sheet is removed to allow for lifting of the backing sheet from a closed or seated position and swinging it about the hinged edge to provide access to the frame interior for inserting or changing pictures.

U.S. Pat. No. 4,736,538 to Pierce et al. discloses a device for retaining and displaying one or more photographs includes a pair of frames which are mirror images and are connected along one edge by a hinge. Each frame has an outer wall approximately equal in size and shape to the photograph and a plurality of side walls extending at an obtuse angle in the same direction from a periphery of the outer wall. The hinge permits the frames to be moved from an open position wherein the photograph can be inserted between the outer walls to a closed position wherein the photograph is retained between the outer walls. An opening in at least one of the outer walls permits the photograph to be displayed. An outer surface of each of the outer walls has a groove formed therein for retaining one end of a pair of legs attached to a base portion of a clip. The base portion of the clip can be placed on a generally horizontal surface and the legs will maintain the outer walls of the frames in a generally vertical position to display the photograph. Interior latch means can be provided to maintain the frames in the closed position.

However, these patents fail to disclose a multi-purpose apparatus for receiving, holding, transporting, protecting, displaying and/or storing a diploma, certificate, photograph or the like which has the features of the present invention. More specifically, these patents fail to disclose a convertible protective holder and/or wall display having a first panel and second panel wherein the first panel may rotate three hundred and sixty degrees behind the second panel and may be secured behind the second panel in a quick and efficient manner. A need, therefore, exists for an improved multi-purpose apparatus for receiving, holding, transporting, protecting, displaying and/or storing a diploma, certificate, photograph or the like as described in the present application which can quickly convert from a protective holder to a wall display.

SUMMARY OF THE INVENTION

The present invention generally relates to a multi-purpose, double paneled, convertible apparatus which may be used as a protective holder and/or wall display for a diploma, certificate, photograph or the like. The apparatus may provide a safe and secure manner for receiving, holding, transporting, protecting, and/or storing, for example, the diploma, certificate, photograph or the like and further may quickly be converted to provide an attractive display for hanging the diploma, certificate, photograph or the like on a wall. In addition, the apparatus may be used to display the diploma, certificate, photograph or the like on, for example, a table. The apparatus may have a first panel which may be connected to a second panel. Further, the first panel may rotate with respect to the second panel. The second panel may store the diploma, certificate, photograph or the like while the first panel may provide a cover for the diploma, certificate, photograph or the like. The second panel may have at least one strap which may secure the first panel, when rotated behind the second panel. In addition, the reverse side of the first panel may have an attachment for hanging the apparatus on, for example, a wall.

An advantage of the present invention is to provide a multi-purpose apparatus consisting of a protective holder and/or wall display which is environmentally friendly in that it reduces materials consumed in producing both a holder and a wall display.

An advantage of the present invention is to provide a multi-purpose apparatus consisting of a protective holder and/or wall display which can quickly convert from a protective holder to a wall display for a diploma, certificate, photograph or the like.

Still another advantage of the present invention is to provide a multi-purpose apparatus consisting of a protective holder and/or wall display in which a document, certificate, diploma, photograph or the like may be easily placed or secured and from which a document, certificate, diploma, photograph or the like may be easily removed.

An advantage of the present invention is to provide a multi-purpose apparatus consisting of a protective holder and/or wall display which may be used to secure a diploma, certificate, photograph or the like which is light-weight.

An advantage of the present invention is to provide a multi-purpose apparatus consisting of a protective holder and/or wall display which may be used to receive a diploma, certificate, photograph or the like.

An advantage of the present invention is to provide a multi-purpose apparatus consisting of a protective holder and/or wall display which may be used to hold a diploma, certificate, photograph or the like.

An advantage of the present invention is to provide a multi-purpose apparatus consisting of a protective holder and/or wall display which may be used to transport a diploma, certificate, photograph or the like.

An advantage of the present invention is to provide a multi-purpose apparatus consisting of a protective holder and/or wall display which may be used to protect a diploma, certificate, photograph or the like.

A further advantage of the present invention is to provide a multi-purpose apparatus consisting of a protective holder and/or wall display which may be used to secure a diploma, certificate, photograph or the like which may allow a first panel to quickly rotate approximately three hundred and sixty degrees with respect to a second panel.

Another advantage of the present invention is to provide a multi-purpose apparatus consisting of a protective holder and/or wall display which may be used to secure a diploma, certificate, photograph or the like which has a strap for securing a first panel behind a second panel.

An advantage of the present invention is to provide a multi-purpose apparatus consisting of a protective holder and/or wall display which may be used to secure a diploma, certificate, photograph or the like which has a device for hanging the invention on the wall.

An advantage of the present invention is to provide a multi-purpose apparatus consisting of a protective holder and/or wall display which may be used to display a diploma, certificate, photograph or the like.

An advantage of the present invention is to provide a multi-purpose apparatus consisting of a protective holder and/or wall display which may be used to store a diploma, certificate, photograph or the like.

A still further advantage of the present invention is to provide a multi-purpose apparatus consisting of a protective holder and/or wall display which may be used to secure a diploma, certificate, photograph or the like which may have a protective layer for protecting a document.

Yet another advantage of the present invention is provide a multi-purpose apparatus consisting of a protective holder and/or wall display which may be used to archive and preserve, in an acid free environment, a document, certificate, diploma, photograph or the like.

For a more complete understanding of the above listed features and advantages of the multi-purpose apparatus holder and/or wall display reference should be made to the following detailed description of the preferred embodiments and to the accompanying drawings. Further, additional features and advantages of the present invention are described in, and will be apparent from, the detailed description of the preferred embodiments and from the drawings.

BRIEF DESCRIPTION OF THE DRAWING

FIGS. 3A-3D illustrate a perspective view of the first embodiment of the multi-purpose apparatus holder and/or wall display of the present invention wherein the apparatus is moved from position 3A to position 3D.

DETAILED DESCRIPTION OF THE PREFERRED EMBODIMENTS

The present invention generally relates to a multi-purpose, double paneled, convertible apparatus which may be used as a protective holder and/or wall display for a diploma, certificate, photograph or the like. The apparatus may provide a safe and secure manner for receiving, holding, transporting, protecting, and/or storing, for example, the diploma, certificate, photograph or the like and further may quickly be converted to provide an attractive display for hanging the diploma, certificate, photograph or the like on a wall. In addition, the apparatus may be used to display the diploma, certificate, photograph or the like on, for example, a table. The apparatus may have a first panel which may be connected to a second panel. Further, the first panel may rotate with respect to the second panel. The second panel may store the diploma, certificate, photograph or the like while the first panel may provide a cover for the diploma, certificate, photograph or the like. The second panel may have at least one strap which may secure the first panel, when rotated behind the second panel. In addition, the reverse side of the first panel may have an attachment for hanging the apparatus on, for example, a wall.

Figure 1:
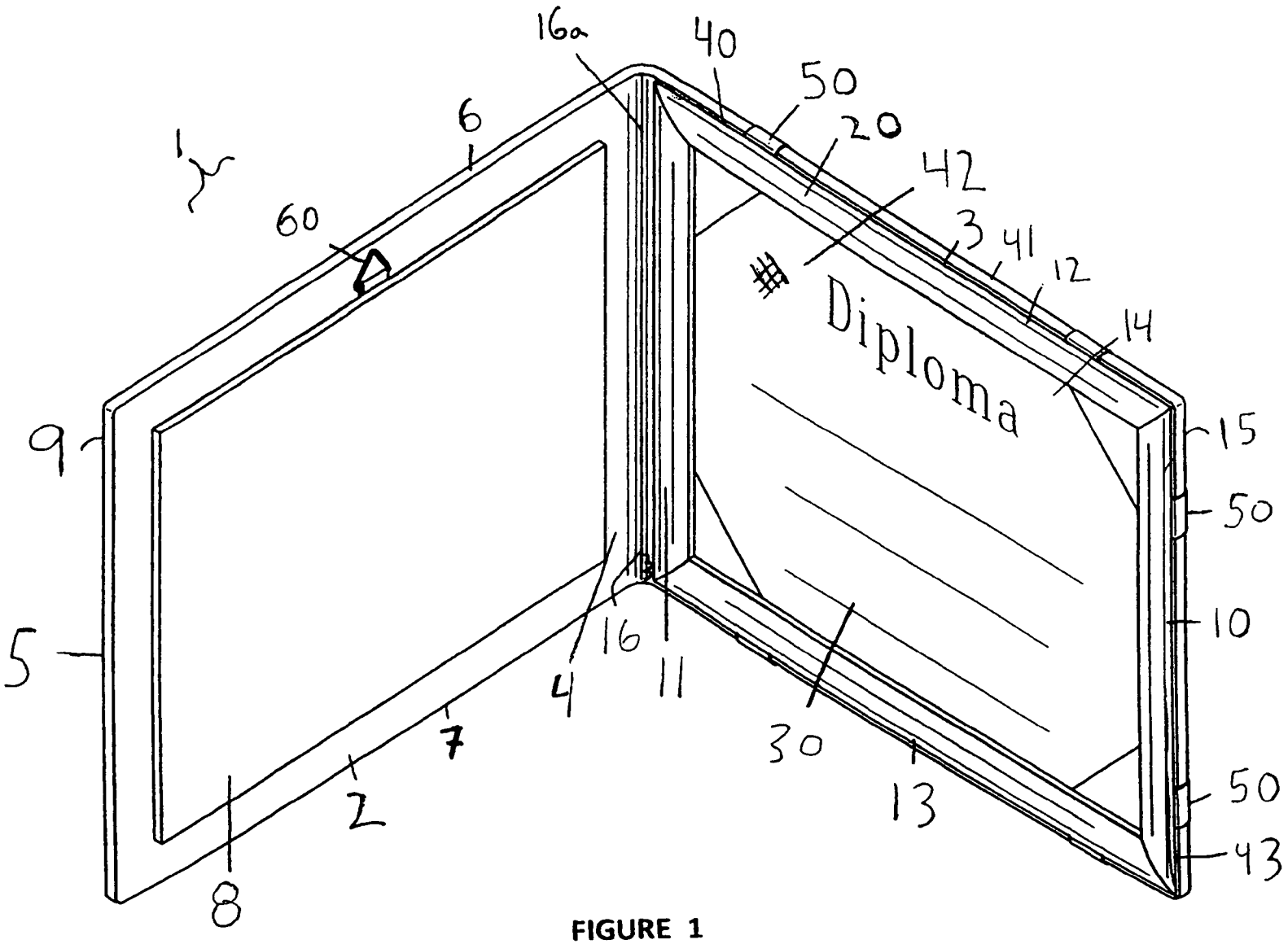
FIG. 1 illustrates a front perspective view the first embodiment of the multi-purpose apparatus holder and/or wall display of the present invention wherein the apparatus is in a partly-opened position B.

Referring to FIG. 1, the apparatus 1 may have a first panel 2 and a second panel 3. The first panel 2 may have a first side 4, a second side 5, a top side 6, a bottom side 7, a front 8 and a back 9. The second panel 3 may have a first side 10, a second side 11, a top side 12, a bottom side 13, a front 14 and a back 15. The first side 4 of the first panel 2 may be connected to the second side 11 of the second panel 3 so that the first panel 2 may rotate with respect to the second panel 3. More specifically, the first side 4 of the first panel 2 may be connected to the second side 11 of the second panel 3 by, for example, a hinge 16. Alternatively, the first panel 2 and the second panel 3 may be constructed as a single unit with a crease 16*a* dividing the unit into the first panel 2 and second panel 3 wherein the first panel 2 may rotate with respect to the second panel 3. Further, the first panel 2 may rotate approximately three hundred and sixty degrees with respect to the second panel 3.

The second panel 3 may have a border 20 forming a perimeter 40. The perimeter 40 of the apparatus may be a frame. More specifically, the frame (perimeter 40) may be, for example, a wood, metal, plastic or other material which creates a border around the certificate, diploma, photograph or the like. The perimeter 40 of the border 20 may be smaller than a perimeter 41 of the second panel 3. More specifically, the border 20 of the second panel 3 may be completely within the perimeter 41 of the second panel 3. A diploma, certificate, photograph 30 or the like may be secured within the border 20 of the second panel 3 by, for example, being slid into place between the front 14 of the second panel 3 and a transparent layer 42 secured within the border 20. The transparent layer 42 may be made from, for example, glass, plastic or the like. A slit 43 in the border 20 may allow the user to slide the document 30 between the transparent layer 42 and front 14 of the second panel 3. In an embodiment, the transparent layer 42 may cover substantially the entire surface area of the front 14 of the second panel 3. More specifically, the transparent layer 42 may cover a single document wherein the single document covers substantially the entire surface area of the front 14 of the second panel 3.

A hanging device 60 may be located on the front 8 of the first panel 2. The hanging device 60 may be, for example, a loop, an indentation in a metal tab or the like which is used to hang an item on a nail or hook. When the first panel 2 is rotated into the second position D (FIG. 3), the hanging device 60 may be located on the front 8 of the first panel 2 of the multi-purpose apparatus holder and/or wall display 1.

Figure 2:
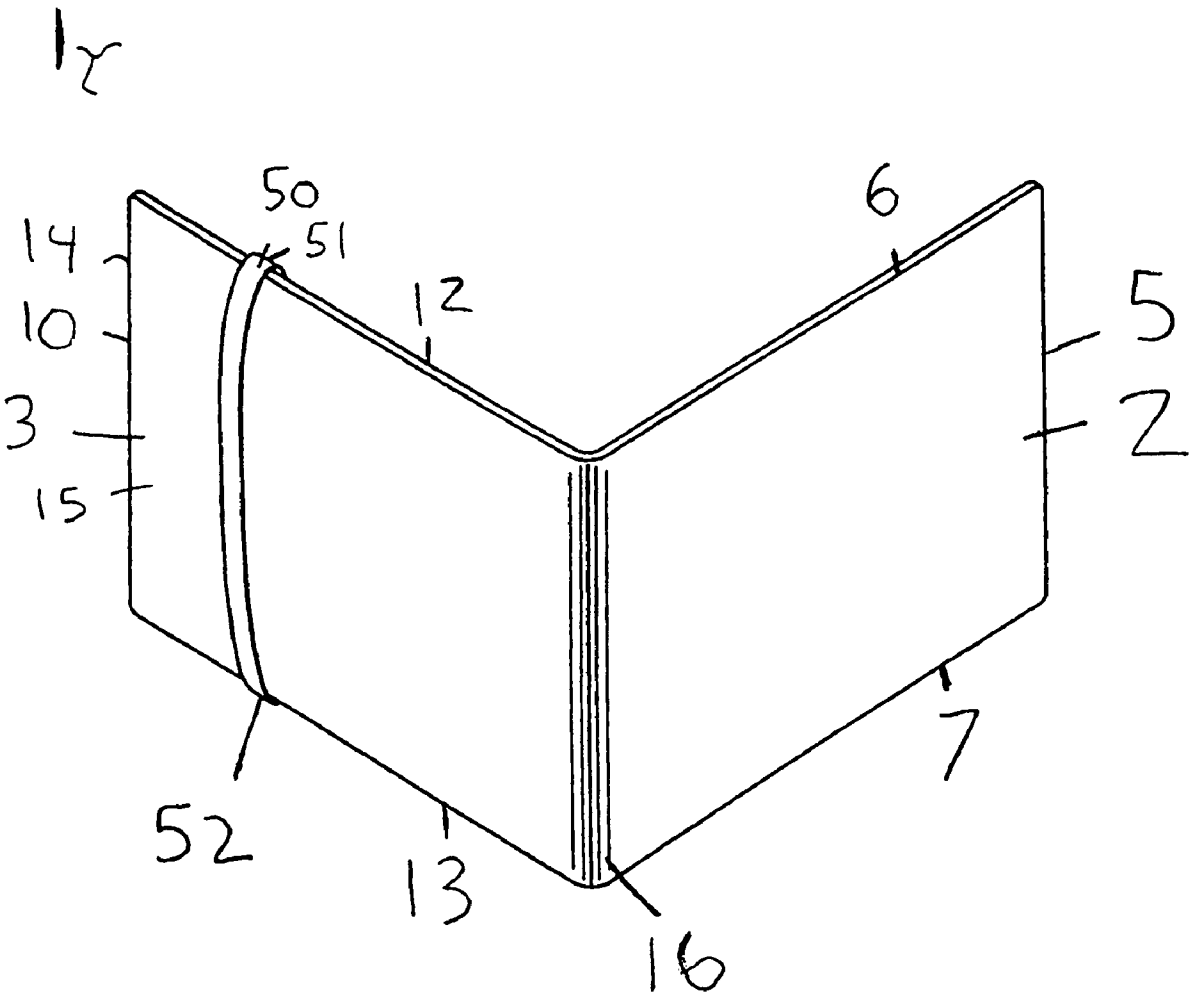
FIG. 2 illustrates a back perspective view of the first embodiment of the multi-purpose apparatus holder and/or wall display of the present invention wherein the apparatus is in a partly-open position B.

Referring now to FIG. 2, the back 15 of the second panel 3 may have, for example, at least one strap 50. The strap 50 may have a first end 51 and a second 52. The first end 51 of the strap 50 may be secured near the top side 12 of the back 15 of the second panel 3 and the second end 52 of the strap 50 may be secured to the bottom side 13 of the back 15 of the second panel 3. When viewing the apparatus 1 from the front, the strap 50 may be located behind the second panel 3 and, therefore, not visible. Preferably, the strap 50 may be constructed from an elastic material such that the user may stretch the strap 50 around the first panel 2 and then release the strap 50 such that the strap 50 may secure the first panel 2 to the second panel 3.

Referring now to FIGS. 3A-3D, the first panel 2 may quickly be rotated approximately three hundred and sixty degrees from a first position A (FIG. 3A) to a second position B (FIG. 3D). In the first position A, the first panel 2 may obscure the view of the diploma, certificate or photograph 30 stored in the second panel 3. When the first panel 2 is rotated behind the second panel 3 the user may secure a portion of the first panel 2 under the strap 50 behind the second panel 3. In this second position B, from the front, the user may view the diploma, certificate, photograph 30 or the like located under the transparent layer 42. Further, in this second position B, the back 9 of the first panel 2 is obscured from view by the second panel 3. In the second position B, the back 9 of the first panel 2 moves into contact with the back side 15 of the second panel 3. As a result, the first panel 2 and the second panel 3 may be secured together and the first panel 2 may be restricted from rotating with respect to the second panel 3. The figures illustrate the first panel 2 and the second panel 3 rotating around the side of the apparatus 1; however, it should be noted that the panels may rotate over the top 12 of the of the second panel 3 of the apparatus 1 (the second embodiment as described below) or the bottom 13 of the second panel 3 of the apparatus 1.

Figure 4:
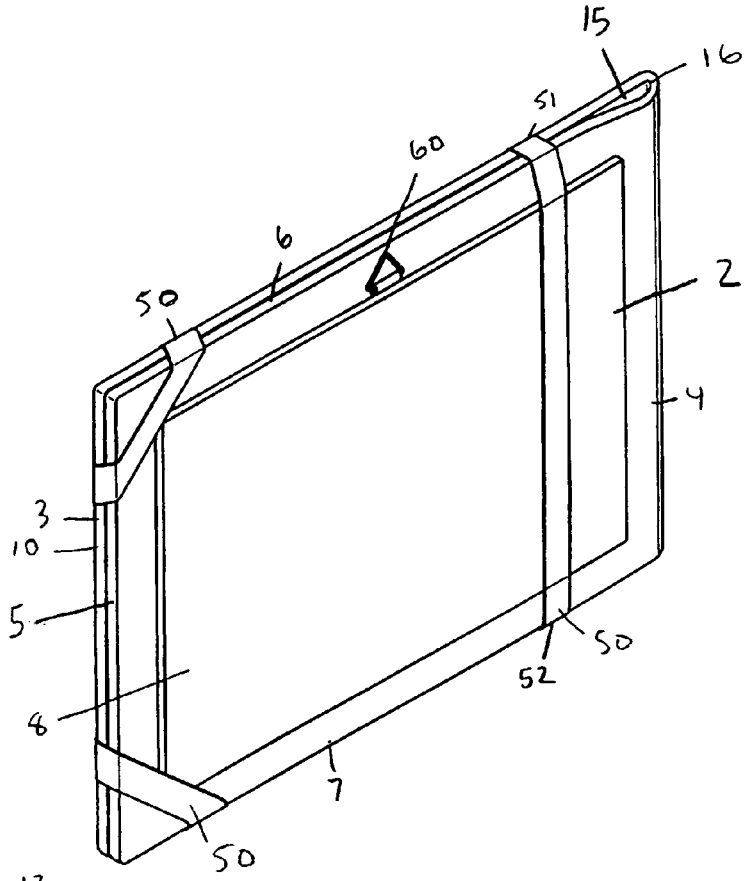
FIG. 4 illustrates a perspective view of the first embodiment of the front side of the first panel of multi-purpose apparatus holder and/or wall display of the present invention wherein the first panel is secured to the second panel.
Figure 5:
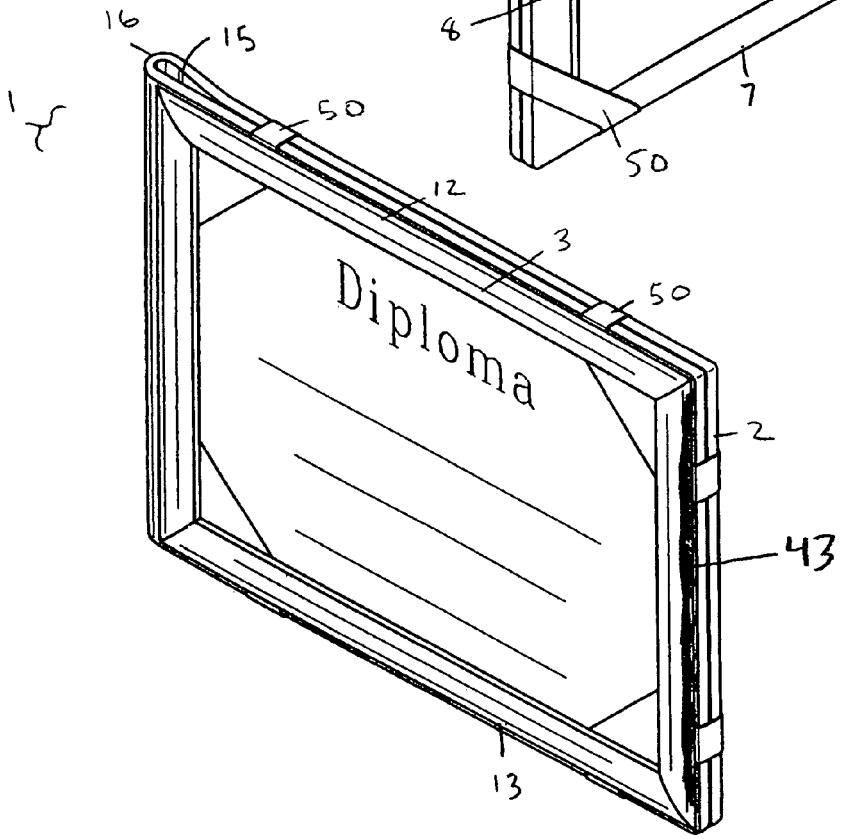
FIG. 5 illustrates a perspective view of the first embodiment of the front side of the second panel of the multi-purpose apparatus holder and/or wall display of the present invention wherein the first panel is secured to the second panel.
Figure 6:
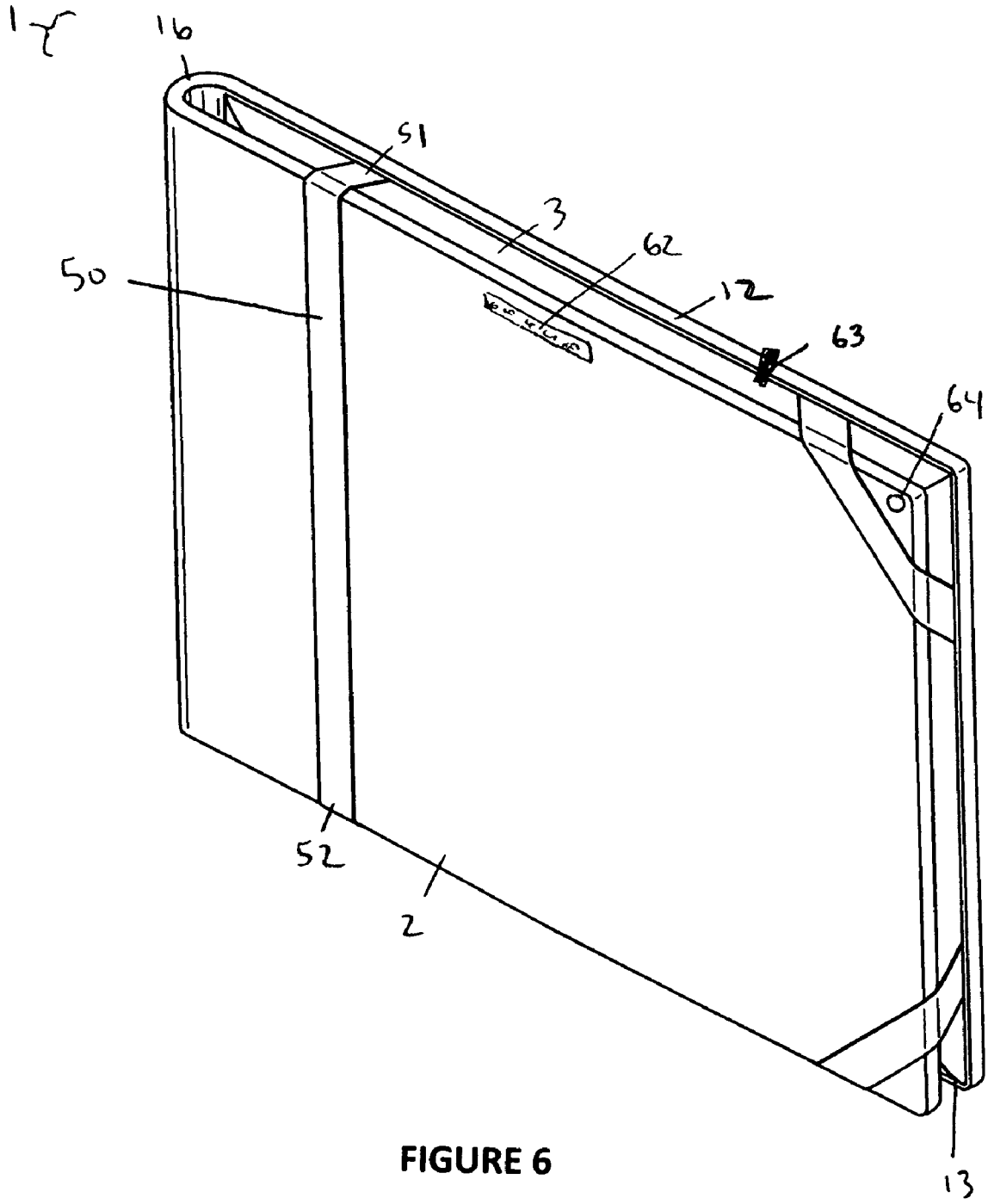
FIG. 6 illustrates a perspective view of the first embodiment of the back side of the first panel of the multi-purpose apparatus holder and/or wall display of the present invention wherein the first panel is secured to the second panel.

Referring now to FIGS. 4 and 5, the back 15 of the second panel 3 may have a plurality of straps 50 which may be used to secure portions of the first panel 2 to the second panel 3. The straps 50 may be elastic so that the user may pull the straps to insert the first panel 2 through an opening 105 (FIG. 3B) between the straps 50 and the back side 15 of the second panel 3. The user may then release the straps 50 and the straps 50 may secure the first panel 2 to the second panel 3.

Figure 7:
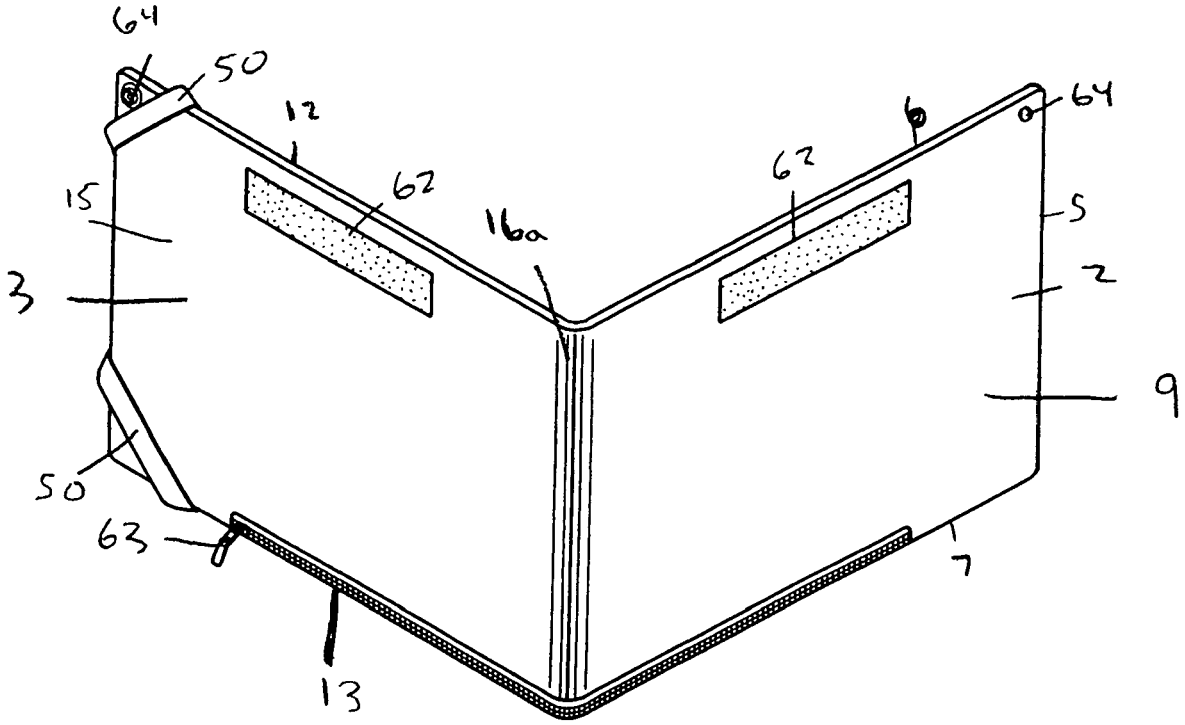
FIG. 7 illustrates a back perspective view of the first embodiment of the multi-purpose apparatus holder and/or wall display of the present invention.

Referring now to FIG. 7, in another embodiment, the back side 9 of the first panel 2 may have a hook and loop fastener strip 62, zipper 63, button 64 or the like which is used to secure the back side 9 of the first panel 2 to a corresponding hook and loop fastener, zipper or button on the back side 15 of the second panel 3. It should be noted that the apparatus may lack a hook and loop fastener strip 62, a zipper 63 or a button 64.

As an alternative to hanging the apparatus on a wall, the apparatus may simply be placed on, for example, a table, mantle, shelf or the like. More specifically, the apparatus 1 may be partly opened, as illustrated in FIG. 1 (between position A and position B). When the apparatus is simply placed on a table, mantle, shelf or the like the first panel 2 is generally at an angle of approximately 20-160 degrees with respect to the second panel 3 such that the apparatus may be stable and will not easily fall over.

Figure 8:
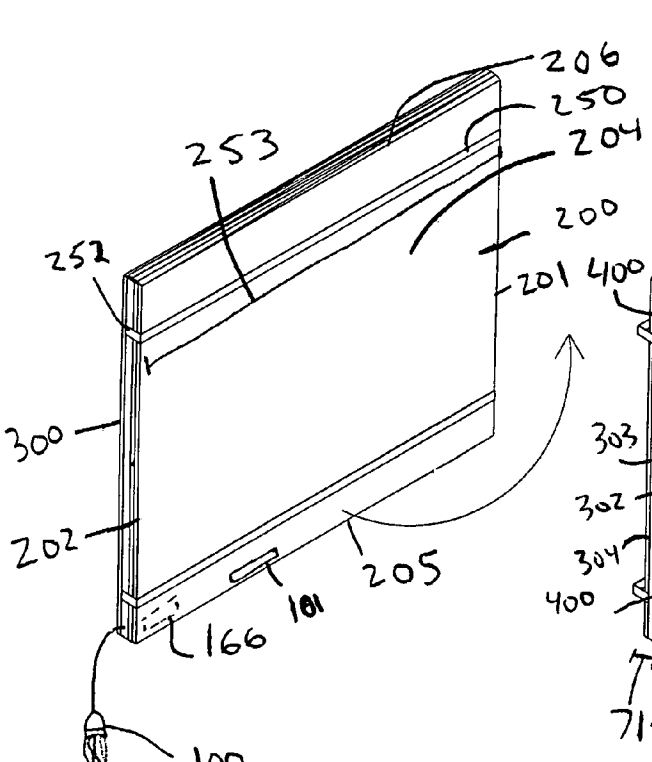
FIG. 8 illustrates a front perspective view of the second embodiment of the present device wherein the first panel is closed over the second panel in the first position A.
Figure 12:
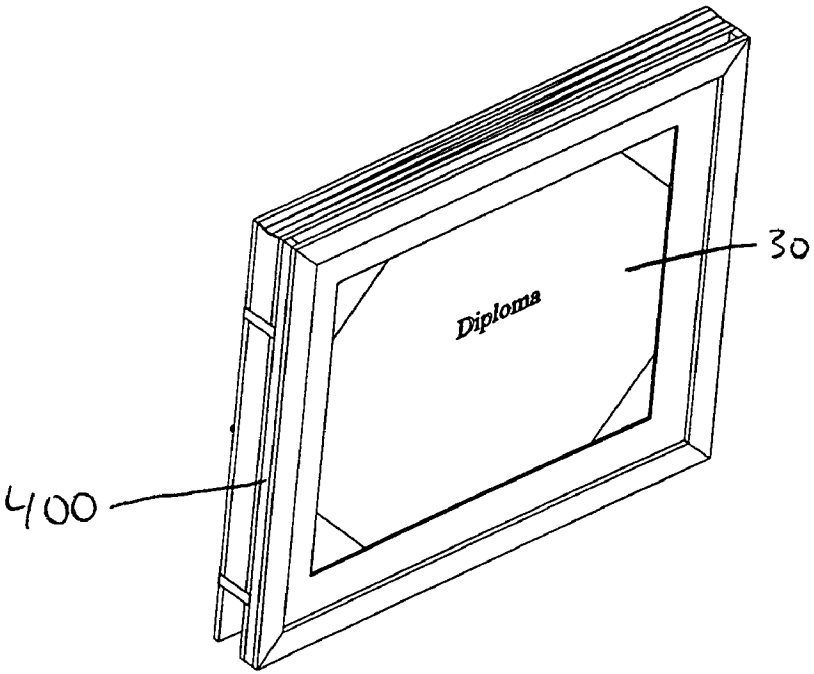
FIG. 12 illustrates a front perspective view of the second embodiment of the present device wherein the first panel is secured behind the second panel in position B.

Referring now to FIG. 8, the apparatus 1 may have a ribbon 100. In an embodiment, the ribbon 100 may be of color(s) which represents a school that issued the diploma or certificate 30. The ribbon 100 may be attached to an electrical sensor 166 located within the device 1. When pulled, the ribbon 100 may activate a light 101 and/or may activate a speaker 102. The speaker 102 may play a prerecorded message, for example, from a loved one or may play music, such as a Pomp and Circumstance march or a school fight song.

Figure 10:
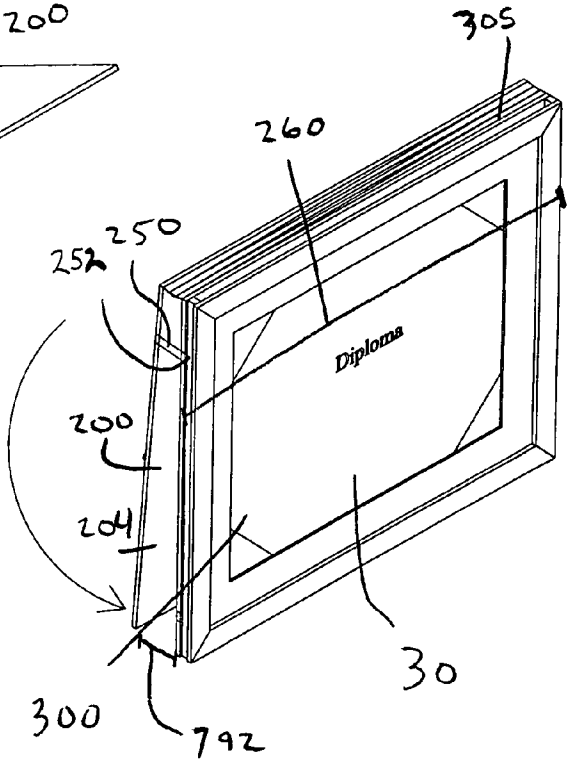
FIG. 10 illustrates a front perspective view of the second embodiment of the present device wherein the first panel is rotated behind the second panel.
Figure 9:
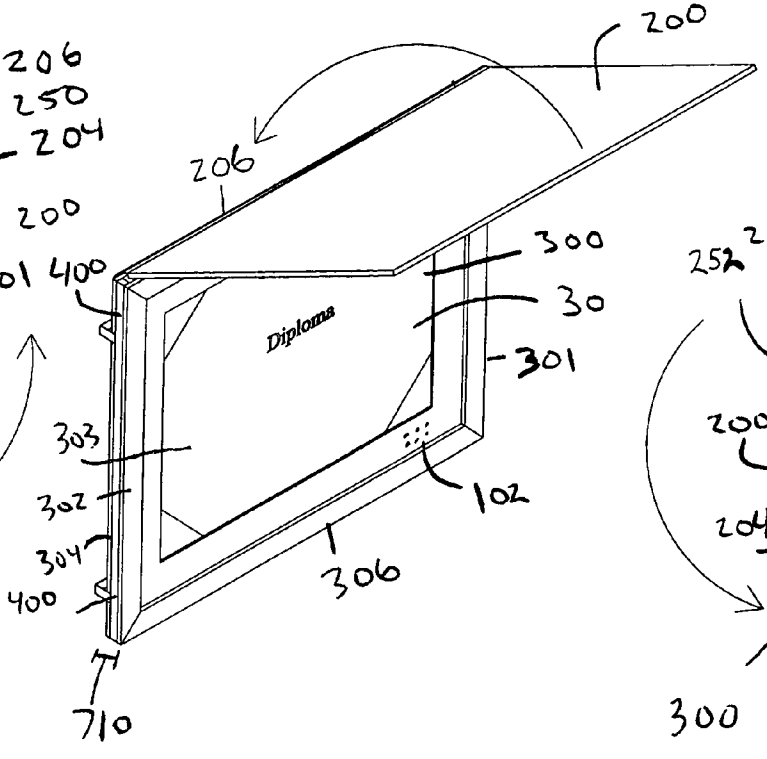
FIG. 9 illustrates a front perspective view of the second embodiment of the present device wherein the first panel is being rotated from the first position A to the second position B.

As stated above and illustrated in FIGS. 8-10, in an embodiment, the device 1 may have an alternative orientation, while still containing some of the previous features as described above. More specifically, the device 1 may have a first panel 200 and a second panel 300. The first panel 200 may have a first side 201, a second side 202, a front 203, a back 204, a top 205 and a bottom 206. The second panel 300 may have a first side 301, a second side 302, a front 303, a back 304, a top 305 and a bottom 306. In the second embodiment, the bottom 206 of the first panel 200 may be connected to the top 305 of the second panel 300.

A strap 250 may be located near the top 305 of the second panel 300. The strap 250 may have a first side 251, a second side 252 and a length 253. The strap 250 may be made from a generally elastic material. The length 253 of the strap 250 may be substantially similar to a length 260 of the second panel 300. The first side 251 of the strap 250 may be secured at the first side 301 of the second panel 300, between a spacer 400 (as defined below) and the front 303 of the second panel 300. The second side 252 of the strap 250 may be secured at the second side 302 of the second panel 300, between a spacer 400 and the front 303 of the second panel 300.

The strap 250 may move from a first position A (FIG. 8) to a second position B (FIG. 10). In the first position A, the strap 250 may be located over the back of the first panel 200. In this position A, the first panel 200 and second panel 300 are secured together and wherein the front 303 of the second panel 300 faces the front 203 of the first panel 200. In the second position B, the strap 250 may be moved to the front 203 of the first panel 200. More specifically, after the first panel 200 rotates upward over the second panel 300, the back 304 of the second panel 300 may be now located next to and secured next to the back 204 of the first panel 200. The strap 250 may then secure the first panel 200 such that the first panel 200 may not rotate away from the second panel 300 more than a slight distance 792 which may stabilize the device and allow the device to stand upright and be displayed.

Figure 14:
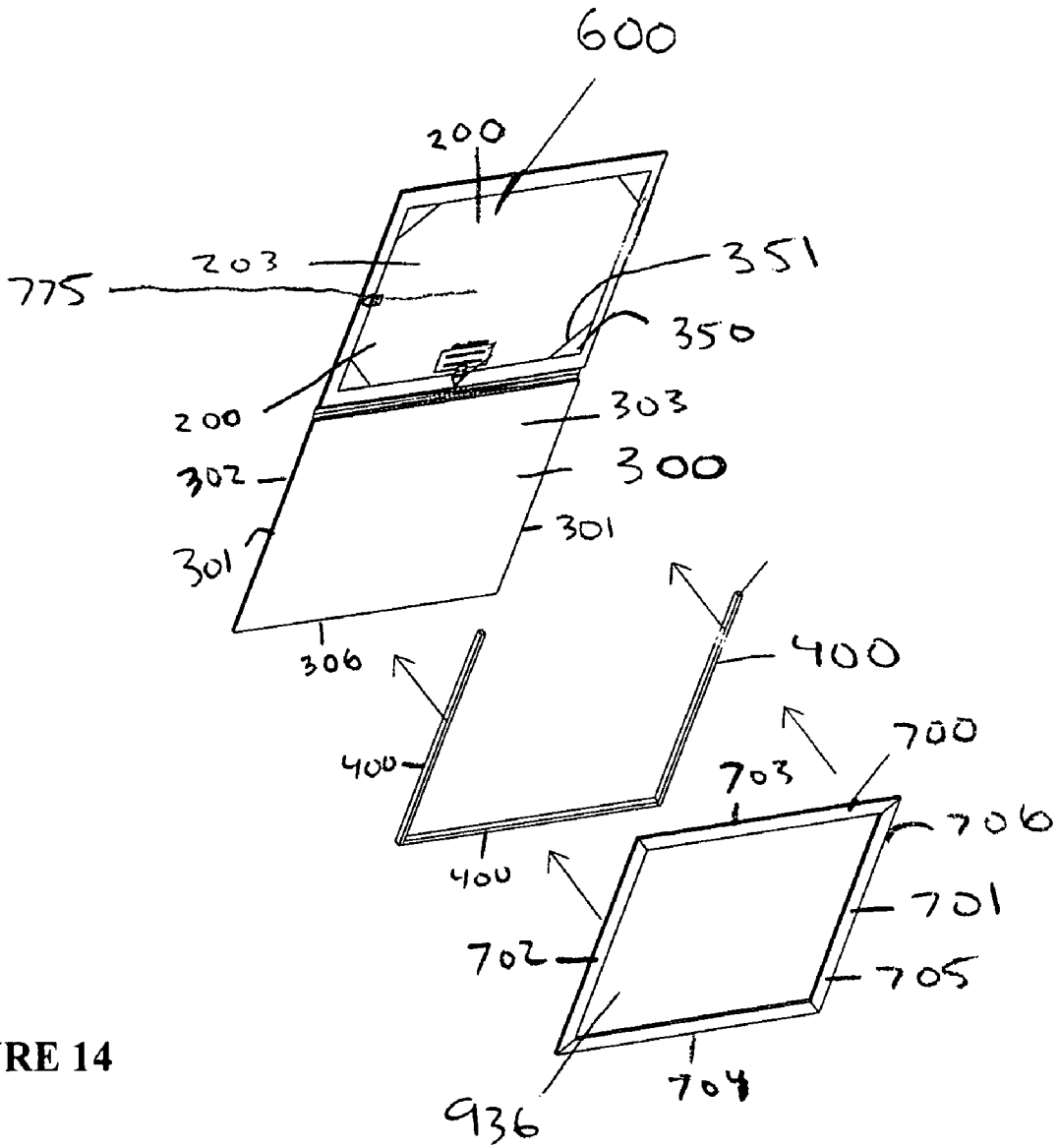
FIG. 14 illustrates an exploded view of the second embodiment of the present device.

The front 203 of the first panel 200 may have a plurality of holders 350. FIG. 14 illustrates the first panel 200 having four holders 350. The holders 350 may be generally triangular in shape. The holders 350 may have three sides wherein two of the three sides are secured to the front 203 of the first panel 200 and wherein the third side is loose 351. The loose end 351 of each of the holders 350 may face inward toward a center 775 of the front 203 of the first panel 200. The holders 350 may have a perimeter which is smaller, and generally in proportion, with the perimeter of the first panel 200. A writing page 600 may be inserted after being slightly bent into the four holders 350. The writing page 600 may be flipped to provide additional writing surface on the back.

As stated above, the writing page 600 may be located temporarily secured to the holders 350 of the first panel 200. More specifically, corners 401 of the writing page 600 may be secured under the unsecured side of the holder 350. As a result, the writing page 600 may be temporarily secured by the holders 350. The writing page 600 may allow a user, family member or friend to write a message or leave a note with the device 1. The writing page 600 may be removed and replaced or may be flipped and the back side of the writing page 600 may be used for additional writing surface.

Figure 15:
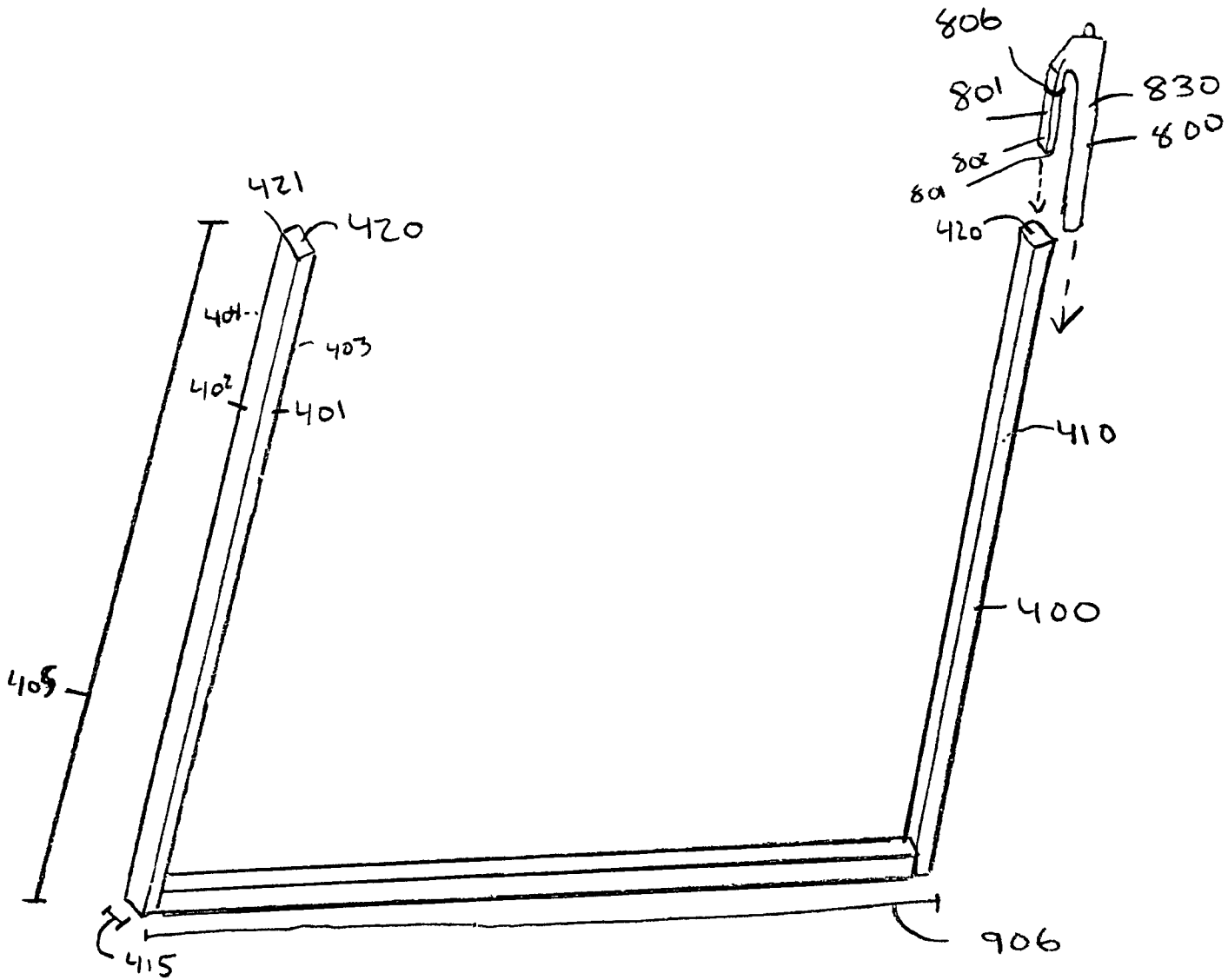
FIG. 15 illustrates a side perspective view of the spacer of the second embodiment of the device 1.

Referring now to FIGS. 14 and 15, the first side 301, second side 302 and the bottom 306 of the second panel 300 may have a spacer 400. The spacer 400 may have four sides 401, 402, 403 and 404 and a length 405. The spacer 400 on the first side 301 of the second panel 300 may be identical to the spacer 400 on the second side 302 of the second panel 300. The spacer 400 on the bottom 306 of the second panel 300 may be longer in length than the spacer 400 on the first side 301 and second side 302. The spacer 400 on the first side 301, second side 302 and bottom 306 may have a generally hollow interior 410. The spacer 400 may also have a width 415. The width 415 of all the spacers 400 may be identical.

The spacer 400 may run along the first side 301, bottom 306 and second side 302 of the front 303 of the second panel 300. The spacer 400 may provide support for a frame 700 and may distance the frame 700 (FIG. 14) of the second panel 300 from the front 303 of the second panel 300. As a result, a mat 500 and the transparent layer 42 may be slid through and may fit between the frame 700 and the front 303 of the second panel 300. The interior 410 of the four sides 401, 402, 403 and 404 may create a generally square opening 420 on the top 421 of the spacer 400 on the first side 301 and second side 302.

A writing utensil 800 may have a clip 801. The clip 801 of the writing utensil 800 may have a first side 802, second side 803, front 804 and back 805 defining a perimeter 806. The perimeter 806 of the clip 801 of the writing utensil 800 may be substantially similar to the interior perimeter defined in the hollow interior 410 of the spacer 400. The writing utensil 800 may therein be secured to the device 1 when the clip 801 of the writing utensil 800 is inserted into the generally square opening 420 on the top 421 of the spacer 400. In this position, the clip 801 is inserted partially into the spacer 400 while a body 830 of the writing utensil 800 is located outside of the spacer 400 and, therefore, outside of the external perimeter of the second panel 300 of the device 1. The writing utensil 800 may therein be temporarily secured to the device 1 via the spacer 400 and held in place by, for example, friction. A user may remove the writing utensil 800 to write on the writing page 600 surface.

Figure 13:
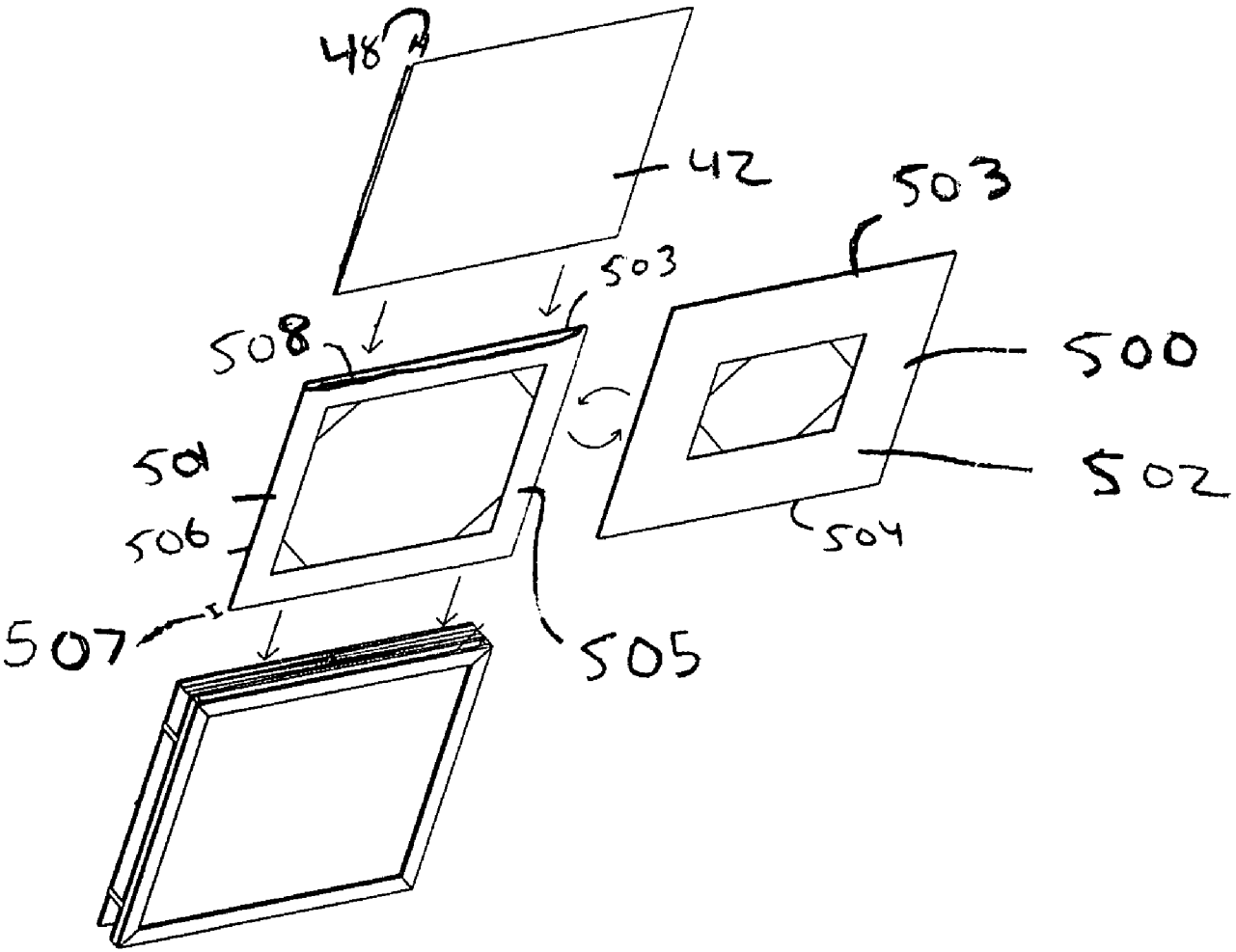
FIG. 13 illustrates a front view of the mat and transparent layer of the second embodiment being inserted into the second panel of the second embodiment.
Figure 16:
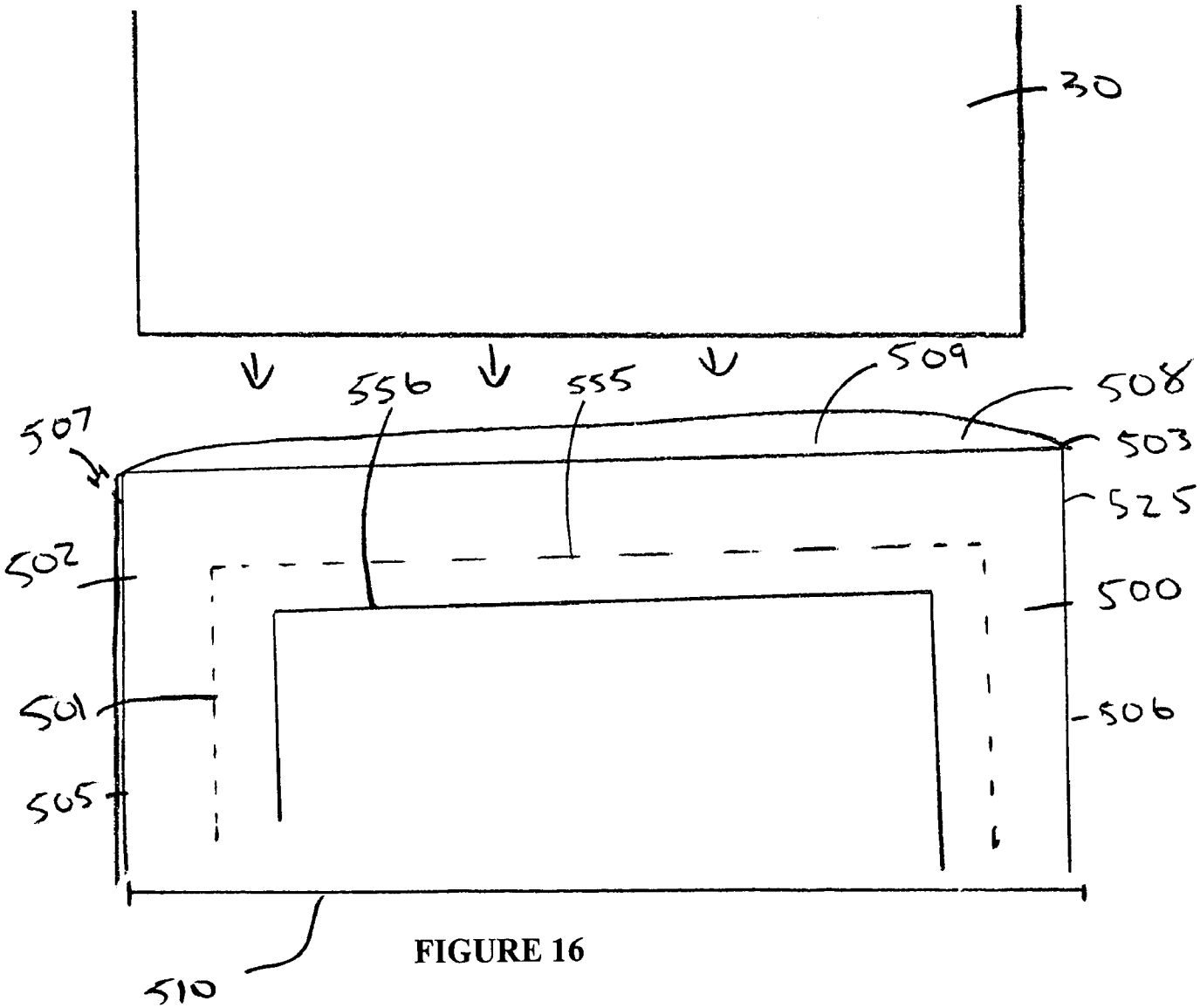
FIG. 16 illustrates the mat of the second embodiment of the present device.

A reversible mat 500 (FIG. 13 and FIG. 16) may be used with the device 1. The mat 500 may have a front 501 (in phantom in FIG. 16), a back 502 a top 503, a bottom 504, a first side 505, a second side 506, a width 507, a slit 508 and an interior 509. The slit 508 may be present on the top 503 of the mat 500 and may allow the diploma, certificate, photograph 30 to be inserted into the interior 509 of the mat 500, between the front 501 and the back 502. The mat 500 may further have a length 510. The length 510 of the mat 500 may be substantially similar to a length of the bottom 906 spacer 400. Further, the width 507 of the mat 500 may be less than the width 415 of the spacer 400.

The front 501 of the mat 500 may be different from the back 502 of the mat 500. More specifically, the front 501 of the mat 500 may have a border window 555 which is not equal to a border window 556 of the back 502 of the mat 500. The border may not be transparent. As a result, more of the diploma, certificate or photograph 30 may be visible viewing the diploma, certificate, photograph 30, for example, from the front 501 than the back 502. Therefore, a user may elect to have the front of the diploma, certificate or photograph 30 facing the front 501 or the back 502, depending on the size of the diploma, certificate, photograph 30 or the preference of the user. As a result, the mat 500 of the device 1 is suitable for displaying a diploma, certificate or photograph 30 of different sizes without the need for additional mats 500. The mat 500 may further have colors on the front 501 and back 502. The colors may be identical or may be different.

As stated above, the mat 500 may have an external perimeter 525 and an internal perimeter (555 or 556). The external perimeter 525 of the mat 500 may be identical regardless of viewing the mat 500 from the front 501 or the back 502. The internal perimeter (555 or 556 depending on which side of the mat 500 is displayed) may be different; therein allowing for more or less of the diploma 30 to be viewed.

Figure 11:
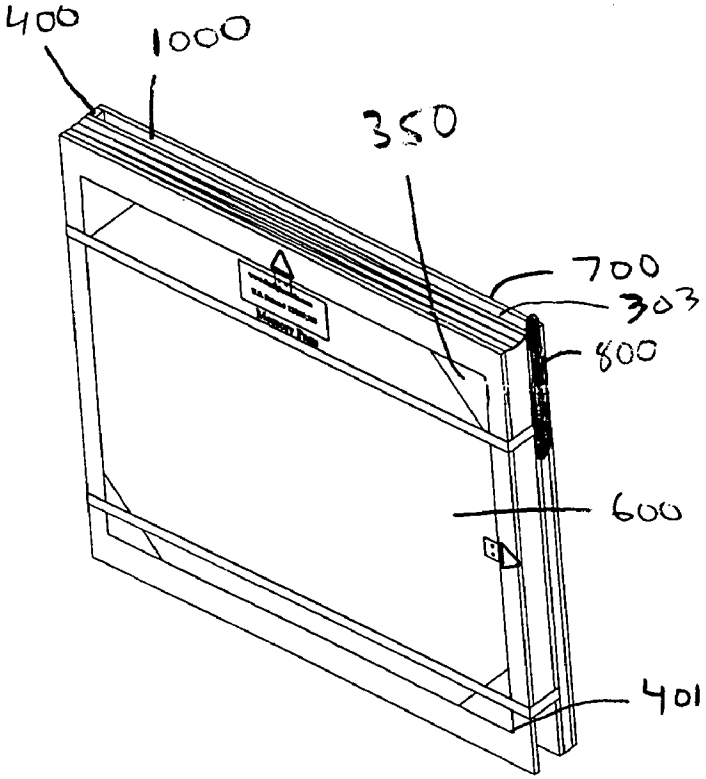
FIG. 11 illustrates a back perspective view of the second embodiment of the present device wherein the first panel is secured behind the second panel in position B.
Figure 17:
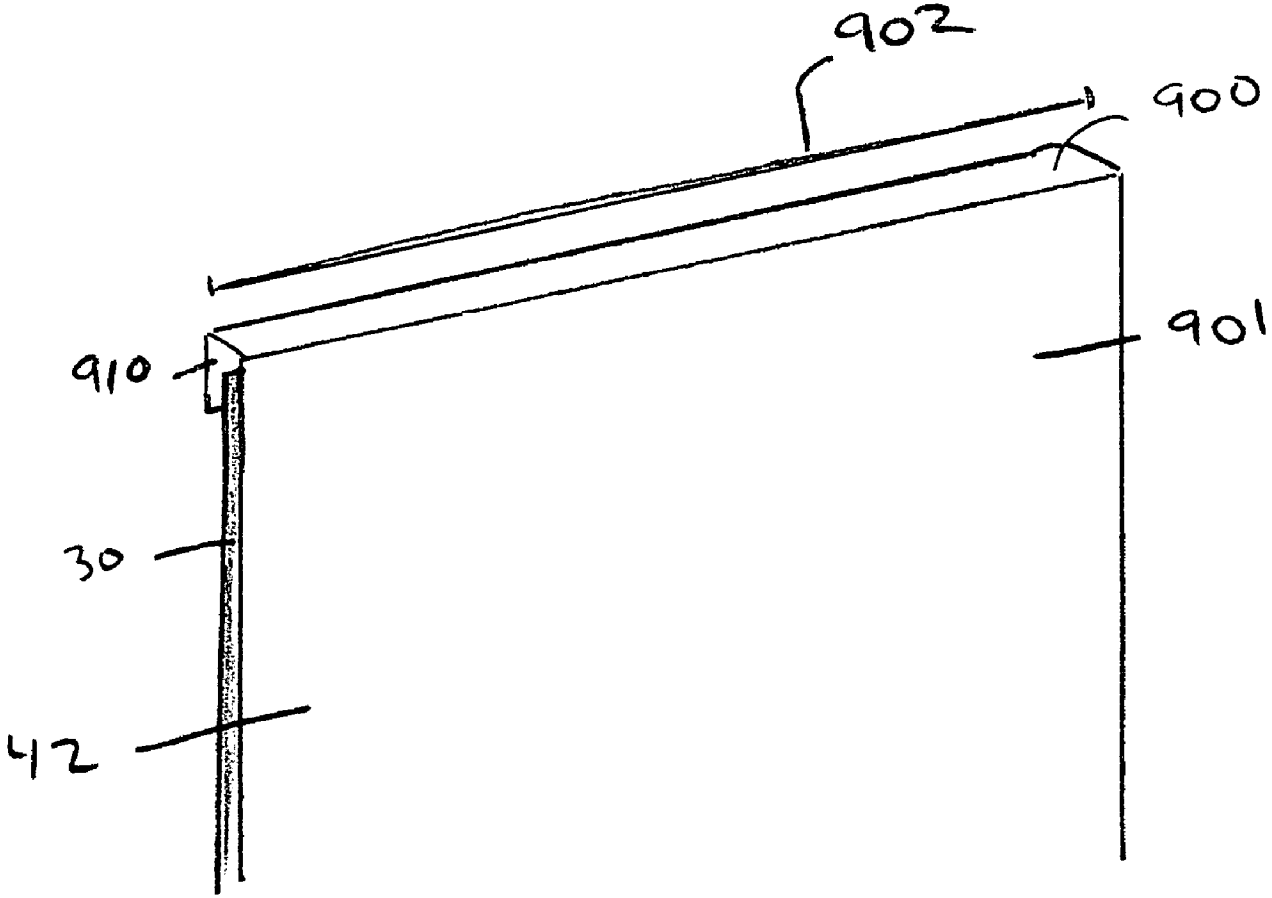
FIG. 17 illustrates the top of the transparent layer in an embodiment.

The transparent layer 42 may have a width 48. The width 48 of the transparent layer 42 plus the width 507 of the mat 500 may be substantially similar to the width 415 of the spacer 400. Referring now to FIG. 17, in an embodiment, the transparent layer 42 may have a top edge 900 generally rectangular in shape. The top edge 900 may run substantially perpendicular to the main body 901 of the transparent layer 42. The top edge 900 may have a length 902 which is identical to the length of the transparent layer 42. A second edge 910 may extend downward from the top edge 900 so that the top edge 900 and second edge 910 and main body 901 for a generally u-shape. The second edge 910 may run substantially parallel to the main body 901 of the transparent layer 42. The top edge 900 may protect the diploma, certificate or photograph 30 while the diploma, certificate or photograph 30 is placed in the device 1. More specifically, the top edge 900 may cover the opening slit 1000 (FIG. 11) created on the top 305 of the second panel 300 (from the lack of the spacer 400 along the top 305 of the second panel 300).

The frame 700 of the device 1 may have a first side 701, a second side 702, a top 703, a bottom 704, a front 705 and a back 706. The first side 701, second side 702, and bottom 704 of the back 706 may be secured to the spacers 400. As a result, the frame 700 may be supported by the spacers 400. Further, the spacer 400 may provide distance (a width 710) from the back 706 of the frame 700 to the front 303 of the second panel 300. The distance 710 (FIG. 9) between the frame 700 and the second panel 300 may be slightly greater than the combined width of the mat 500, diploma 30 and the transparent layer 42.

As stated above, a spacer 400 may be lacking on the top 305 of the second panel 300 therein creating an opening slit 1000. The top edge 900 of the transparent layer 42 may largely occupy the opening slit 1000; therein protecting the diploma, certificate, photograph or the like 30.

The frame 700 may have an opening interior 936 which may allow the mat 500 and diploma, certificate, photograph or the like 30 to be displayed behind the transparent layer 42. The opening interior 7936 may substantially occupy the front 705 of the frame 700.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A generally rectangular certificate holder comprising:

a first panel having a first side, a second side, a top side, a bottom side, a front side and a back;

a second panel having a first side, a second side, a top side, a bottom side, a front side and a back and wherein the first panel and the second panel are directly connected together at a single crease and wherein the first panel may quickly rotate approximately three hundred and sixty degrees around the crease with respect to the second panel;

a generally rectangular spacer having a width extending along the entire first side, second side and bottom side of the second panel wherein the generally rectangular spacer separates the front side of the second panel from a picture frame having a first side, second side, top and bottom creating a perimeter and wherein the generally rectangular spacer has a hollow interior and wherein a certificate is placed between the picture frame and the front side of the second panel;

a writing utensil having a clip wherein the clip has a generally square-shaped exterior surface; and an opening at a top end of the generally rectangular spacer of the first side of the second panel and an opening at a top end of the generally rectangular spacer of the second side of the second panel wherein the opening at the top end of each generally rectangular spacer is square-shaped and wherein the square-shaped opening is substantially identical in size and shape to the generally square-shaped exterior surface of the clip of a writing utensil and wherein the writing utensil is temporarily secured within the opening at the top end of the generally rectangular spacer.

2. The generally rectangular certificate holder of claim 1 further comprising:

a transparent layer secured to and located in front of the front side of the second panel wherein the transparent layer allows for the viewing of an item located between the transparent layer and the front side of the second panel.

3. The generally rectangular certificate holder of claim 1 further comprising:

a hook or other hanging device located on the front side of the first panel wherein the hook or other hanging device is used to secure the display frame on a wall.

4. The generally rectangular certificate holder of claim 1 further comprising:

a slit located between the transparent layer and the front side of the second panel wherein the slit allows the insertion of an item between the transparent layer and the front side of the second layer.

5. The generally rectangular certificate holder of claim 1 wherein substantially the entire front side of the second panel is covered by a single transparent layer.

6. The generally rectangular certificate holder of claim 1 further comprising:

a strap having a first end and a second end wherein the first end and the second end are secured to the back of the second panel and wherein the strap moves from a first position to a second position wherein the first position the strap is located along the back side of the first panel and wherein in the second position the strap is located along the front side of the first panel.

7. The generally rectangular certificate holder of claim 1 further comprising:

four generally triangular holders located on the front side of the first panel wherein the four generally triangular holders each having three sides and wherein the four generally triangular holders are located at corners of a perimeter located entirely within a perimeter of the first panel and further wherein two of three of the corners of each of the generally triangular holders are secured to the front side of the first panel and wherein the third side is loose.

8. The generally rectangular certificate holder of claim 1 further comprising:

a surface for writing having a front and a back wherein the surface for writing is reversible and wherein the surface for writing is temporarily secured to the front side of the first panel by four generally triangular holders.

9. The generally rectangular certificate holder of claim 1 further comprising:

a ribbon attached to the generally rectangular certificate holder wherein the ribbon is secured to an electrical device which produces an audible sound when activated by pulling the ribbon.

10. The generally rectangular certificate holder of claim 1 further comprising:

a ribbon attached to the generally rectangular certificate holder wherein the ribbon is secured to an electrical device which produces light when activated by pulling the ribbon.

* * * * *